United States Patent [19]

Chesnut et al.

[11] Patent Number: 4,672,760

[45] Date of Patent: Jun. 16, 1987

[54] SIDE-BY-SIDE CARTRIDGE MAGAZINE FOR RIM-FIRE CARTRIDGES

[75] Inventors: M. Gaines Chesnut, Kremmling; Thomas L. Castetter, Elizabeth, both of Colo.

[73] Assignee: Ram-Line, Inc., Golden, Colo.

[21] Appl. No.: 805,303

[22] Filed: Dec. 4, 1985

[51] Int. Cl.[4] ..... F41C 25/02

[52] U.S. Cl. ..... 42/50

[58] Field of Search ..... 42/50

[56] References Cited

U.S. PATENT DOCUMENTS

| | | | |
|---|---|---|---|
| 1,148,981 | 11/1915 | Carl | 42/50 |
| 1,833,862 | 11/1931 | Schmeisser | 42/50 |
| 2,217,848 | 10/1940 | Schillstrom | 42/50 |
| 3,345,771 | 1/1966 | Silsby | 42/18 |
| 3,399,480 | 9/1968 | Rowe, Jr. | 42/50 |
| 3,604,142 | 9/1971 | Silsby | 42/50 |
| 3,952,441 | 4/1976 | Tant | 42/50 |
| 4,112,817 | 9/1978 | Bourlet | 89/33 |
| 4,127,954 | 12/1978 | Hausmann | 42/50 |
| 4,566,212 | 1/1986 | Chesnut | 42/50 |
| 4,589,218 | 5/1986 | Teppa | 42/50 |

FOREIGN PATENT DOCUMENTS

| | | | |
|---|---|---|---|
| 90189 | 3/1896 | Fed. Rep. of Germany | 42/18 |
| 3305772 | 7/1983 | Fed. Rep. of Germany | 42/50 |

*Primary Examiner*—Charles T. Jordan

*Attorney, Agent, or Firm*—Sheridan, Ross & McIntosh

[57] ABSTRACT

A magazine is provided for housing a predetermined number of rim-fire cartridges in a double column configuration with minimal magazine width and length requirements. The magazine is configured so that the rims of the cartridges are automatically placed in a nested or staggered relationship when they are inserted and are maintained in that relationship as they move through the housing, so as to prevent cross over of the rims and jamming. The nested, side-by-side positional relationship of the cartridges in the magazine is changed to a single file relationship while the lateral force exerted on the cartridges is controlled and jamming caused by friction or deformation is prevented. A split follower device having two followers which are movable with respect to each other is provided to maintain an upward bias on the cartridges throughout their movement through the magazine.

23 Claims, 11 Drawing Figures

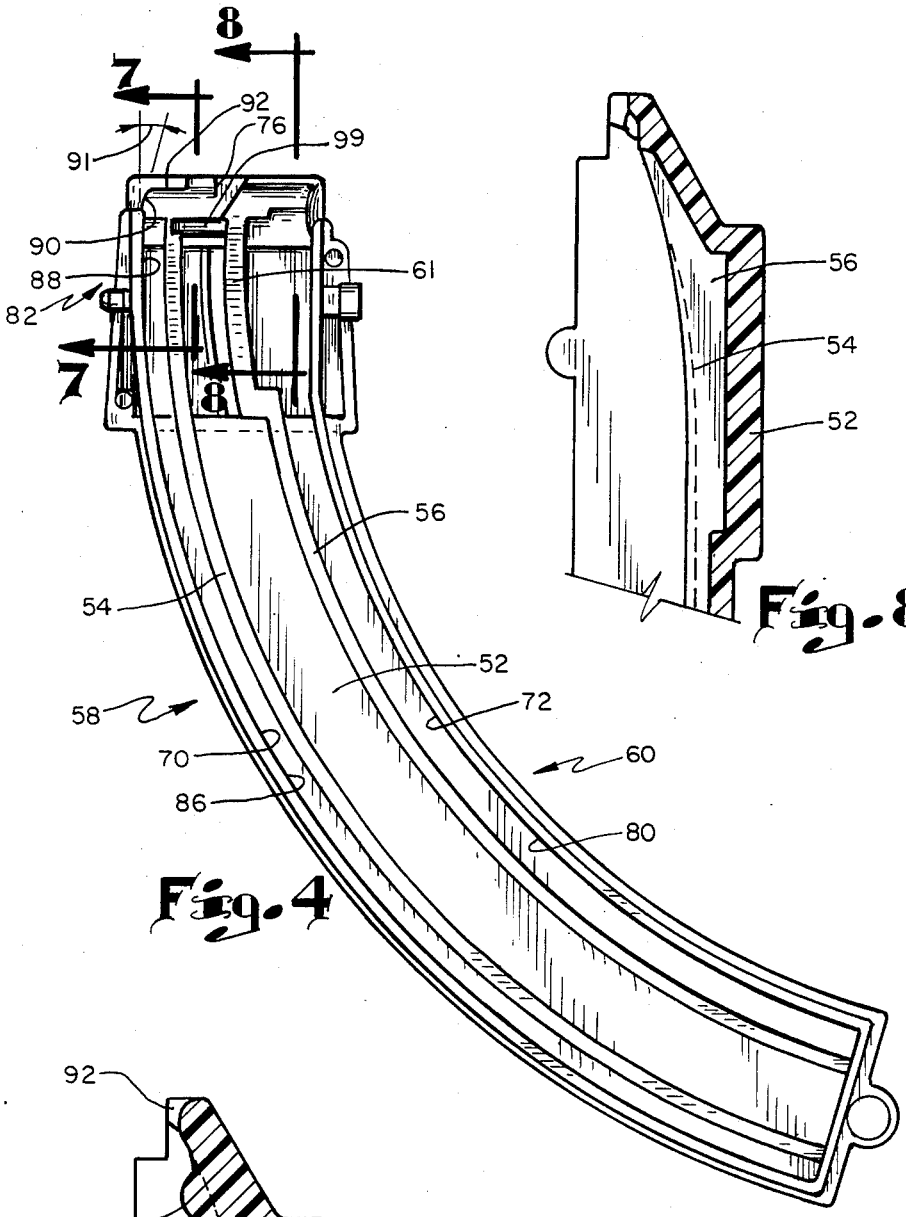
Fig. 4
Fig. 8
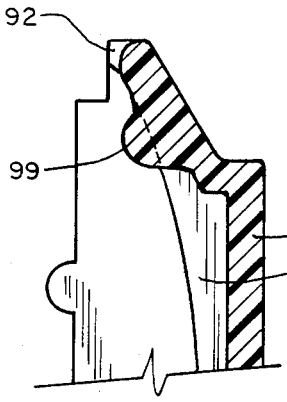
Fig. 7

SIDE-BY-SIDE CARTRIDGE MAGAZINE FOR RIM-FIRE CARTRIDGES

FIELD OF THE INVENTION

The present invention relates to method and apparatus for storing rim-fire cartridges in a side-by-side relationship and in particular to a method and apparatus which maximizes the number of rim-fire cartridges which are stored in a magazine of a given size and yet avoids jamming of cartridges as they move through the magazine.

BACKGROUND INFORMATION

Cartridges used with firearms are commonly classified as center-fire or rim-fire, depending on the position of the "primer" in the cartridge. As used herein, "rim-fire" particularly refers to cartridges which are of an enlarged rim configuration, i.e., which have a rim section of a greater diameter than the diameter of the body portion of the cartridge. This type of cartridge has created a number of problems for the design of magazines intended to house such cartridges. In particular, it is difficult to house such cartridges in a space-efficient manner without creating a jamming problem.

It is known that the length of a magazine designed to house a given number of cartridges can be reduced by storing the cartridges in two columns, such as the arrangement depicted in German Pat. No. 90189 issued Mar. 21, 1896 to Clausius. It is further known that the width of two-column magazines can be reduced by offsetting the columns as shown in U.S. Pat. No. 4,112,817, issued Sept. 12, 1978 to Bourlet.

Such two-column arrangements require some means for feeding the cartridges one at a time into the firearm in an orderly fashion. Previous methods have attempted to accomplish this by tapering the interior of the magazine to force two or more columns into a single column, before feeding into the firearm. Such an approach is depicted in U.S. Pat. No. 2,217,848, issued Oct. 15, 1940 to Schillstrom; U.S. Pat. No. 3,345,771, issued Oct. 10, 1967 to Silsby; and U.S. Pat. No. 3,604,142, issued Sept. 14, 1971 to Silsby. These patents do not recognize, or disclose how to solve, certain problems inherent in a tapering approach to a single file feed from a multiple column magazine. In particular, these patents do not disclose how to control the lateral force exerted on the cartridges by the side walls so as to prevent jamming, and yet keep the magazine length to a minimum.

Furthermore, none of these references are directed to rim-fire cartridges and the problems associated therewith. Rim-fire cartridges are particularly difficult to house in a multiple column magazine because the rims must, at least for the uppermost cartridges, be in a relationship so as not to interfere with one another upon extraction of the uppermost cartridge from the magazine. Further, this provision for noninterference of rims must itself be compatible with other provisions for avoiding jamming as the two-column relationship is changed to a single file relationship.

Another method of housing rim-fire cartridges in a strictly single file relationship is shown in U.S. Pat. No. 4,127,954, issued Dec. 5, 1978 to Hausmann. This patent, however, neither recognizes nor discloses how to solve the problems associated with double column storage of rim-fire cartridges and the transition from a double column of cartridges to a single file arrangement of cartridges.

SUMMARY OF THE INVENTION

The present invention relates to a magazine for housing .22 caliber rim-fire cartridges in a nested, side-by-side relationship. In order to house a maximum number of cartridges in a predetermined size magazine without jamming of the cartridges, either when inserting or ejecting the cartridges, the magazine incorporates a number of interrelated structural features.

First, throughout the length of the magazine chamber, the cartridges are nested or arranged in a staggered relationship. That is, a portion of each rim of each cartridge lies between one end wall of the magazine and a portion of the rim of a preceding cartridge. The chamber includes a storage zone and a transition zone. In the storage zone, except for the lowermost cartridge in the magazine, each cartridge in the storage zone contacts at least three different cartridges. In the transition zone, each of the cartridges contacts less than three cartridges. To achieve this nesting feature, rails are provided on opposite halves of the magazine. The distance or space between the rails of the two halves is important. In the preferred embodiment of the magazine for use with .22 caliber rim-fire cartridges, the distance between the rails in the storage zone for housing the cartridges is about 0.455 inches with a tolerance of only about ±0.015 inches. A second feature relates to the configuration of the storage zone. This area of the magazine is arcuate-shaped. The radius of the interior surface of one end wall of this arcuate section should be about 6.24 inches with a tolerance of only about ±0.25 inches. A third feature found in the present invention is incorporated on the first of two magazine end walls. The first end wall is adjacent to the rims of the cartridges housed in the magazine. Specifically, the first end wall includes three sections, each section characterized by a different shape. The first section is arcuate shaped. The second section of the end wall is connected to the arcuate-shaped portion and is substantially straight. The third section is connected to the second or straight section of the end wall and is located adjacent to the opened end of the magazine. This third section is a straight line having a predetermined angle, preferably 10°, relative to the straight second section. Another feature relates to the rail configuration provided on the first of the two magazine halves. In the preferred embodiment, rails on the first half change to a parabolic shape near the opened end of the magazine. The parabolic-shaped rail sections begin in the same upper portion of the magazine that includes the second straight section of the end wall. This interrelationship between the parabolic-shaped rail sections and the end wall straight section is necessary to assure smooth movement of the cartridges and avoid jamming. Still yet another feature included in the present invention is a projection formed on a rail found on the second half of the magazine. The projection is located adjacent to the opened end of the magazine and is used to insure that the cartridges are maintained in the desired, nested relationship. Lastly, the magazine of the present invention in the preferred embodiment includes a split or dual follower in which one follower is movable relative to the other follower. The split follower contacts the two lowermost cartridges and enables each of the two followers to "walk" relative to the other during at least some of the movement of the split follower as cartridges are moved into and out of the magazine.

In view of the foregoing summary, a number of advantages of the present invention are readily discernible. A cartridge magazine is provided for housing a number of rim-fire cartridges in a side-by-side relationship. The length of the housing is minimized for a given number of cartridges, and yet jamming problems are eliminated. As a result, a magazine is provided that has reliable and safe feeding of rim-fire cartridges into a firearm.

Additional advantages of the present invention will become readily apparent from the following discussion, when taken in conjunction with the accompanying drawings.

BRIEF DESCRIPTION OF THE DRAWINGS

FIG. 4 is an elevational view of the first half of the magazine;

FIG. 7 is a fragmentary, cross-sectional view, taken along lines 7—7 of FIG. 4, showing the parabolic shape of the rail section located relatively adjacent to the first end wall;

FIG. 8 is a fragmentary, cross-sectional view taken along lines 8—8 of FIG. 4, showing the parabolic shape of the rail section located relatively adjacent to the second end wall;

DETAILED DESCRIPTION

Figure 6:
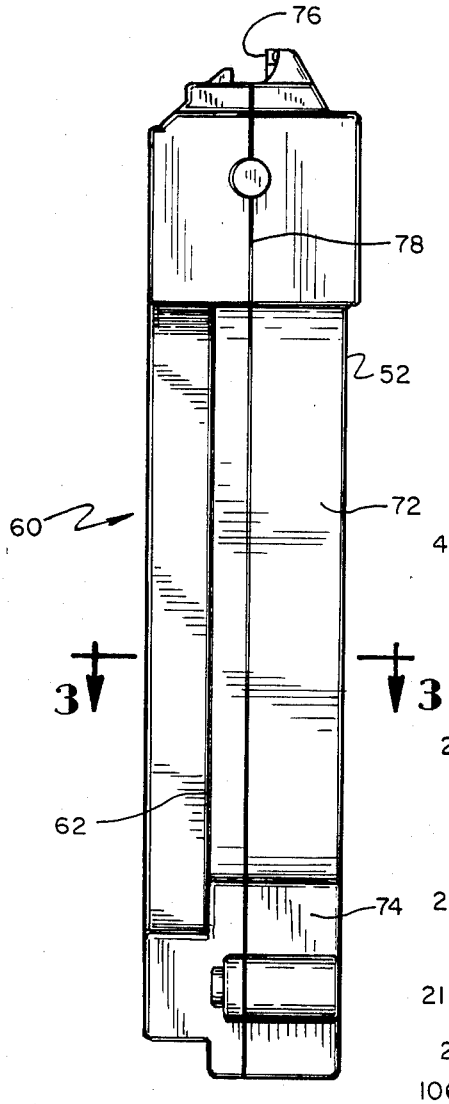
FIG. 6 is an elevational view of the magazine.

The present invention provides apparatus and method for housing a plurality of .22 caliber rim-fire cartridges in a side-by-side relationship so as to optimize packing of the greatest number of cartridges in a storage zone of a magazine while minimizing length and width requirements for the magazine. This configuration minimizes or eliminates jamming of the cartridges as they move through the magazine, and particularly through that region of the magazine where the cartridges are changed from a nested, side-by-side relationship to single file feed of a cartridge through an opening at the top of the magazine. This invention is based on the recognition of two factors that can cause jamming of cartridges in such magazines. The first causative factor is the tendency of the rims of the rim-fire cartridges to "cross over" so that part of the rim of the uppermost cartridge lies behind (i.e., closer to the adjacent end wall) a part of the succeeding cartridge, interfering with removal of the uppermost cartridge from the magazine. The second causative factor is the tendency to develop excessive forces between the cartridge and the magazine wall during transition from a side-by-side relationship to a single file relationship. Such forces inhibit proper sliding movement of the cartridges through the magazine.

The present invention includes a number of features designed to circumvent or eliminate these causative factors. According to this invention, the cartridge rims are maintained in a nested or staggered relationship during the travel of the cartridges through the magazine. The region of the magazine in which the side-by-side relationship of the cartridges is changed to a relationship appropriate for single file feeding of the cartridges into the firearm is designed to assure that the force exerted by a cartridge against the magazine wall or rail is sufficiently low to prevent jamming. In a preferred embodiment, a follower device comprising two followers, each having a certain geometric configuration and being movable with respect to each other, assists in maintaining the proper upward force on the cartridges and thus prevents cross over and also controls cartridge side wall forces. The upper portion of a first end wall is designed in an angled configuration to assure the proper nested or staggered relationship of the cartridge rims when cartridges are loaded into or removed from the magazine.

Before discussing the structural make-up of the magazine, the positional relationship of cartridges within the magazine chamber will first be described. A positional relationship of cartridges in the magazine chamber is provided which minimizes the length and width of the magazine for a given plurality of cartridges but still eliminates or reduces jamming of the cartridges. The cartridges housed in one portion of the magazine, termed the storage zone of the magazine, are in a nested, side-by-side relationship. Preferably, the side-by-side relationship is one in which the centers of three successive cartridge rims lie about at the vertices of an equilateral triangle and in which a portion of the body of each cartridge is contacted by a portion of the rim of the preceding cartridge. For purposes of terminology used in this application, one cartridge "precedes" another if the center of its rim is closer to the open end of the magazine. Creating an equilateral triangle relationship of the centers of successive cartridge rims optimizes the packing of cartridges into the magazine. That is, it is believed that this angular relationship, in a double column cartridge arrangement, accommodates the greatest number of rim-fire cartridges in a magazine of a given longitudinal extent without jamming problems. This result apparently occurs because (1) the force of each cartridge against a side wall in such an angular relationship is insufficient to cause jamming (due to increased friction against or deformation of the side wall) and (2) each cartridge is not allowed sufficient freedom of movement that its rim is able to slip past or "cross over" the rim of another cartridge (loss of nested relationship).

In the case of a magazine having essentially the same longitudinal extent but with a thickness less than that thickness which results in the equilateral triangle relationship, proper movement of the cartridges can be achieved in the magazine chamber. However, such a configuration does not maximize the number of rim-fire cartridges in a magazine having the given longitudinal extent.

In order that the cartridges, which are removed from the housing for insertion into the firearm, be removed in single file fashion through the opened end of the housing, a region of the housing, termed the transition zone, is included in which the positional relationship of the cartridges is changed from a side-by-side relationship. For purposes of this description, the relationship of the cartridges in the transition zone of the housing will be termed "single file," although this term should not be construed to require that any cartridges lie directly in line with one another.

Figure 1:
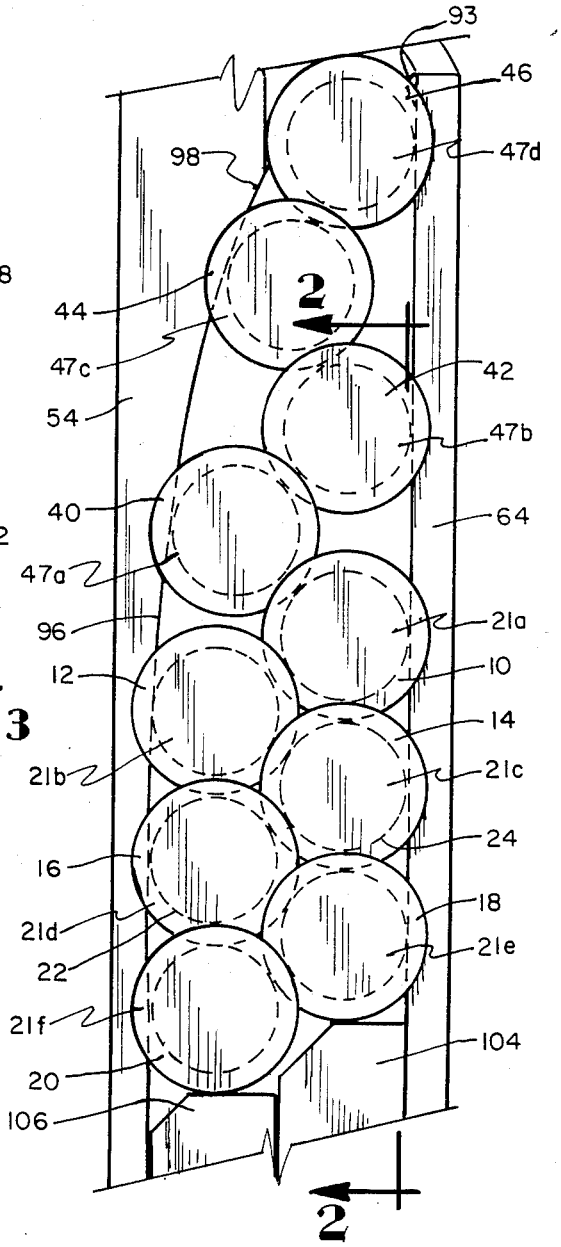
FIG. 1 is an enlarged, fragmentary, sectional view showing the spatial relationship of cartridges in the storage zone and transition zone.

Referring now to FIG. 1, the rims 10, 12, 14, 16, 18, 20 of six cartridges 21*a*, 21*b*, 21*c*, 21*d*, 21*e*, 21*f*, which are in a side-by-side relationship, are shown. The centers of the rims 10, 12, 14 of successive cartridges 21*a*, 21*b*, 21*c* lie at the vertices of an equilateral triangle. Similarly, the centers of the rims 12, 14, 16 of successive cartridges 21*b*, 21*c*, 21*d* lie at the vertices of an equilateral triangle. The body portion 22 of cartridge 21*d*, indicated in FIG. 1 by phantom lines, is contacted by the rim 14 of the preceding cartridge 21*c*. Similarly, the body portion 24 of the cartridge 21*c*, indicated by phantom lines, is contacted by the rim portion 12 of the preceding cartridge 21*b*. It is also noted that in the side-by-side relationship depicted in FIG. 1, the body portion 22 of the cartridge 21*d* is also contacted by the rim portion 12 of a cartridge 21*b* which precedes the preceding cartridge 21*c*, in a manner which can be best seen in FIG. 2.

The rims 40, 42, 44, 46 of four cartridges 47*a*, 47*b*, 47*c*, 47*d*, which are in a "single file" relationship are also shown in FIG. 1. The centers of the rims 40, 42, 44 of successive cartridges 47*a*, 47*b*, 47*d* define a triangle in which the vertex defined by the center of the rim 42 of the middle cartridge 47*b* has an angle greater than 60°. Similarly, the centers of the rims 42, 44, 46 of successive cartridges 47*b*, 47*c*, 47*d* define a triangle in which the vertex defined by the center of the rim 44 of the middle cartridge 47*c* has an angle greater than 60°.

Figure 2:
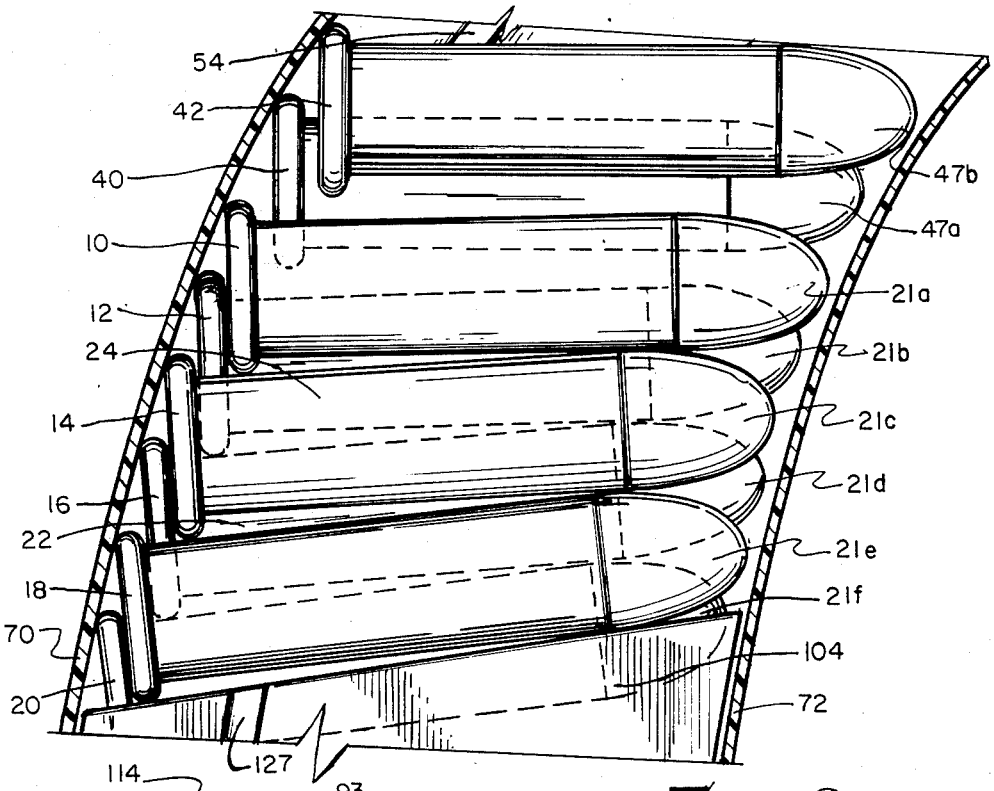
FIG. 2 is an enlarged, fragmentary, cross-sectional view, taken along lines 2—2 of FIG. 1, showing the positional relationship of cartridges in the storage and transition zones.

Another aspect of the positional relationship of the cartridge which is important to this invention is the nested or staggered relationship of the cartridge rims. As used herein, "nested relationship" of cartridge rims means a positional relationship in which a portion of the rim of each cartridge lies between the adjacent end wall of the housing and a portion of the rim of the preceding cartridge. In contrast to the "side-by-side" relationship which is required only in the storage zone of the housing, the nested relationship of the cartridge rims exists for all cartridges in the housing whenever there is more than one cartridge therein. This nested relationship is continuously maintained as cartridges are inserted into the housing or removed from the housing through the opened end of the housing. The nested relationship of the cartridge rims is best seen in FIG. 2. A portion of the rim 20 of the lowermost cartridge 21*f* can be seen to lie between the first end wall 70 and a portion of the rim 18 of the preceding cartridge 21*e*. Similarly, a portion of the rim 18 of cartridge 21*e* lies between the first end wall 70 and a portion of the rim 16 of the next preceding cartridge 21*d*.

Now that the positional relationship of the cartridges in the housing has been described, the manner in which this positional relationship is created and maintained will be discussed.

Figure 3:
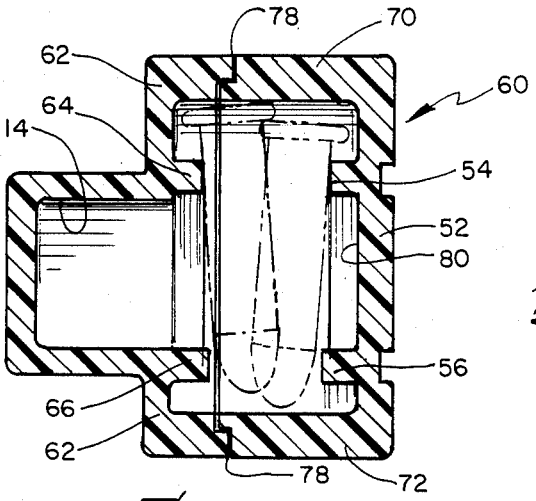
FIG. 3 is a cross-sectional view, taken along lines 3—3 of FIG. 6, showing the distance between the rails formed on connected halves of the magazine.

Maintaining those cartridges in the storage zone in a side-by-side relationship involves a housing having the proper effective thickness and also involves maintaining a force on the lowermost cartridges directed towards the opened end of the housing. As used herein, the "effective thickness" of the housing is the distance between those members which restrain lateral movement (i.e. movement substantially perpendicular to both the cartridge longitudinal axis and the housing longitudinal axis) of the cartridges. Although it is possible to employ the housing side walls as the restraining members, in the preferred embodiment, rails are provided on the side walls to act as the restraining members. Referring now to FIG. 3, a first side wall 52 includes first and second rails 54, 56 in the form of projections extending inward from the first side wall 52. As seen in FIG. 4, the first side wall rails 54, 56 extend into the storage zone 58 of a magazine housing 60. The second rail 56 of the first side wall 52 includes an offset portion 61 that is located adjacent to the opened end of the magazine. Typically, .22 caliber cartridges include knurls adjacent to their nose ends. Although it may not be necessary, in a preferred embodiment, to minimize friction between the second rail 56 and the cartridges as the cartridges move in the area of the magazine adjacent the opened end, the rail 56 is offset so that it no longer contacts the knurls of the cartridges. Instead, contact is only made between the smooth body portion of the cartridges and the offset portion 61 of the second rail 56. In another embodiment, the entire second rail 56 is positioned so that none of the second rail 56 contacts the cartridge knurls.

Figure 5:
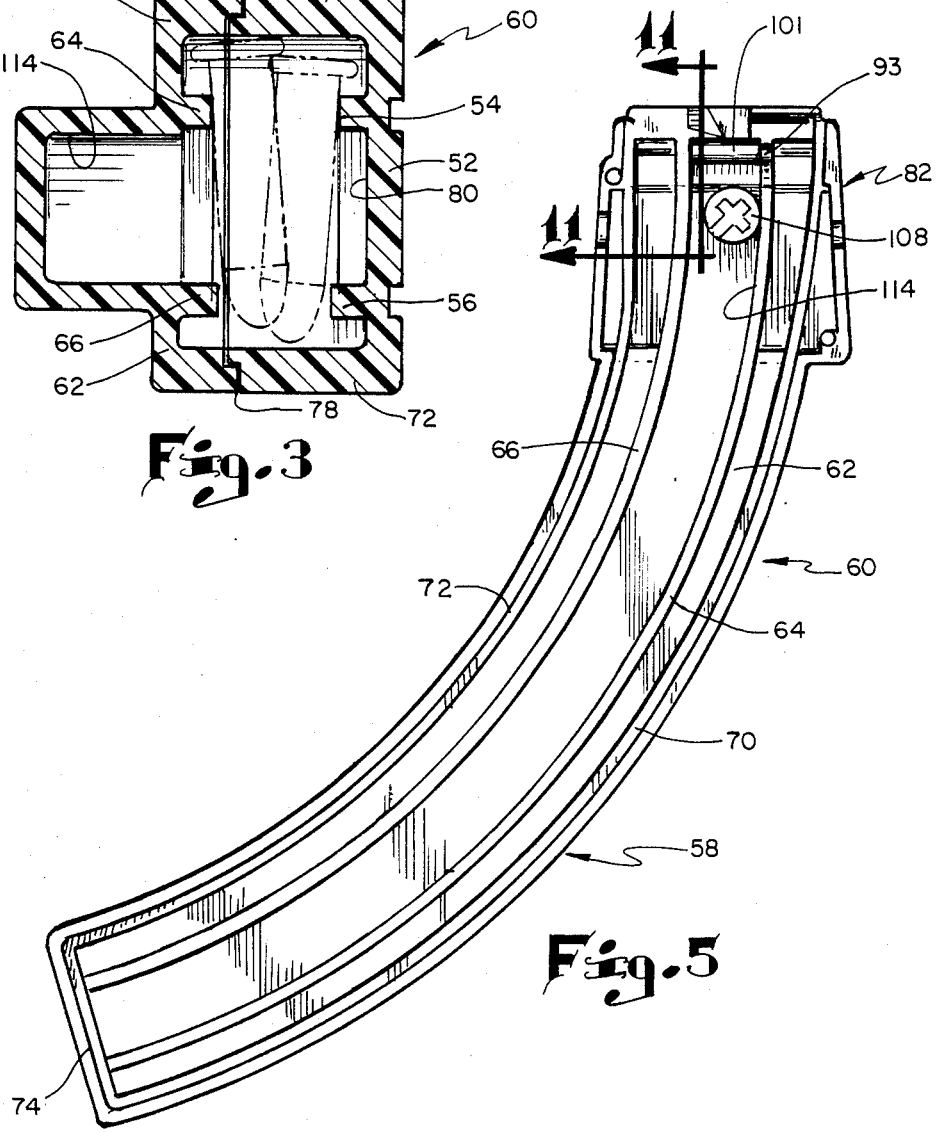
FIG. 5 is an elevational view of the second half of the magazine.

Referring to FIGS. 3 and 5, second side wall 62 includes first and second rails 64, 66, also in the form of elongated projections from the second side wall 62 and which, as seen in FIG. 5, extend into the storage zone 58 of the housing 60. Although the distance may be the same, in the illustrated embodiment, the distance between the first rails 54, 64 of the first and second side walls 52, 62 is greater than the distance between the second rails 56, 66 of the first and second side walls 52, 62. Consequently, the thickness or cartridge storage space of the housing 60 corresponds to the distance between the aligned second rails 56, 66 of the first and second side walls 52, 62.

To maintain the cartridges which are in the storage zone 58 in the nested, side-by-side relationship, the thickness of the housing 60 is about:

$$D + \frac{\sqrt{3}}{2}(D + \Delta r) \qquad \text{(i)}$$

where D is the diameter of the body portion of the cartridge and $\alpha r$ is the radius of the rim portion of the cartridge minus the radius of the body portion of the cartridge. When the housing 60 is to be used for storing .22 caliber cartridges, the thickness of the housing 60 is between about 0.4 inches (1.0 cm) and about 0.5 inches (1.3 cm) and is, preferably, 0.455 inches with a tolerance of only about ±0.015 inches.

In order to maintain the cartridges in the side-by-side relationship, a follower device is included to produce a force urging the cartridges towards the opened end of the housing 60. Briefly, the follower device can be used to overcome the constraints presented by the rails to the movement of the cartridge rims along the body of the magazine. There are other considerations relating to the amount of force needed to be provided by the follower device and these are discussed more fully below. For the present purposes it suffices to note that the follower device contacts both the lowermost cartridge 21*f* and the preceding cartridge 21*e*, applying a force directly to these two cartridges.

The manner in which the cartridge rims are maintained in a nested relationship involves insuring that such a nested relationship is established automatically when rim-fire cartridges are inserted into the housing 60 and also involves constantly maintaining contact between the body portion of any particular cartridge and a portion of the rim of the preceding cartridge.

The manner in which the nested relationship of the rims is established and preserved upon insertion or removal of cartridges through the opened end of the housing 60 is related to certain structural features of the housing 60. As seen in FIG. 6, the housing 60 comprises the first side wall 52 and the second side wall 62, a first end wall 70, a second end wall 72, a bottom end 74 and an opened end 76. In the embodiment shown in FIG. 6, the housing 60 is formed by attaching two mating halves along a seam line 78. As seen in FIG. 3, when the halves are mated along the seam line 78, preferably by such methods as ultrasonic welding or attachment by an adhesive, the first and second end walls 70, 72, first and second side walls 52, 62, form a magazine having a chamber 80. As best seen in FIG. 4, the chamber 80 includes the storage zone 58 and a transition zone 82. The first end wall 70 includes a first section 86 which is substantially arcuate-shaped, a second section 88 which is substantially straight, and a third section 90. The third section 90 is also substantially straight but is formed so as to define a predetermined angle 91 relative to the second section 88 of the inner surface of the first end wall 70. This predetermined angle 91 is at least 5° and is preferably about 10°. In the preferred embodiment, the arcuate section 86 is defined by a radius of about 6.24 inches with a tolerance of only about ±0.25 inches.

The purpose of making the third section 90 angled with respect to the second section 88 is to assure that as cartridges are inserted into the chamber 80 through the opened end 76 of the housing 60, the rim of the uppermost (i.e. closest to the opened end 76) cartridge will be somewhat pushed forward (i.e. in a direction towards the second end wall 72) by contact with the third section 90 of the first end wall 70. Because of this forward position, the rim of a cartridge which is inserted into tne uppermost position in the chamber 80 will contact the body portion of the succeeding (i.e. the next lower) cartridge, which will be forced backward against the second section 88 of the first end wall 70. Thus, the rim of the uppermost cartridge is prevented from riding on the rim of the succeeding cartridge or from passing over the rim of the succeeding cartridge to "cross over" and thus lie behind (i.e. closer to the first end wall 70) the rim of the succeeding cartridge. In this manner, each cartridge which is inserted into the chamber 80 assumes a position such that the rim of the succeeding cartridge lies between the rim of the uppermost cartridge and the first end wall 70 thus placing each inserted cartridge in the desired nested relationship.

The angled relationship of the third section 90 performs a similar function when cartridges are removed from the housing 60. Since the third section 90 forces the uppermost cartridge slightly forward, the rim of the uppermost cartridge is prevented from "crossing over" the rim of the succeeding cartridge as cartridges are removed from the housing 60.

To further establish the desired nesting relationship, a projection 93 is provided on the first rail 64 of the second side wall 62. The projection 93, as seen in FIGS. 1 and 5, is located adjacent to the opened end of the magazine. The projection 93 contacts the body portion of a cartridge and causes it to move such that it is unable to stack directly on top of an adjacent cartridge thereby insuring the nested relationship.

Proper functioning of the second and third sectioins 88 and 90 is assisted using a follower device that exerts a force on the cartridges which tends to urge the cartridges towards the opened end 76 of the housing 60 so as to assure that the rim of the uppermost cartridge is forced upward to bear against the third section 90 and does not slip or fall downwards to bear against the second section 88.

The follower device also performs a second function useful in maintaining the cartridge rims in a nested relationship. This function relates to the fact that if cartridges, which are in a nested relationship, are maintained in such a way that the body portion of any given cartride is continuously in contact with the rim of the preceding cartridge, there can be no cross over of the rims, such as will result in jamming. This result occurs since such cross over would require the event, improbable in the configuration of the apparatus of the present invention, that the body portion of a given cartridge come out of contact with the rim of a preceding cartridge as the rim of a preceding cartridge rides upward and over the rim of the given cartridge.

The manner in which the rim-fire cartridges are maintained in a position so that each cartridge is continuously contacted by a portion of the rim of the preceding cartridge involves maintaining a force on all cartridges directed upwards. The follower device acts to compress the plurality of cartridges between the follower and the openec end 76 of the housing 60. The upward force from the follower device does not eject the uppermost cartridge through the opened end 76 of the housing 60 because the housing 60 includes a mechanism for engaging the uppermost cartridge. The precise configuration of the engaging mechanism will depend upon the intended use of the housing 60 and, particularly, the requirements of the firearm with which the housing 60 can be used. In the embodiments depicted in FIGS. 1–11, the housing 60 is shown in a configuration intended to house .22 caliber rim-fire cartridges and which is intended to be used with a Ruger 10/22 or 77/22 style of firearm. The engaging mechanism in this embodiment comprises a lip member 92. Thus, the cartridges in the chamber 80 are maintained in a compressed condition between lip 92 and the follower device.

In order for the magazine to function properly in cooperation with a firearm to accomplish feeding of rim-fire cartridges stored in the magazine into the firearm for firing of the cartridges, it is necessary that the rim-fire cartridges be extracted from the opened end 76 of the housing 60 one at a time. It is for this reason that cartridges in the area close to the opened end 76 of the housing 60 are in a single file configuration as opposed to a side-by-side positional configuration, as discussed above and as depicted in FIG. 1. When the cartridges in the upper portion of the housing 60 are in a single file configuration, cartridges may be fed from the housing 60 into a firearm in an orderly fashion and without jamming provided the cartridge rims are maintained in a nested position as described above. In order to accomplish feeding of cartridges into a firearm, a force must be maintained on the cartridges in a direction towards the opened end 76 of the housing 60. This force is maintained by the follower device. In order to achieve proper feeding of the cartridges, the upward force must be sufficient to move the plurality of cartridges upward through the chamber 80, as described more fully below, and must be sufficient to achieve an upward acceleration of the cartridges sufficient to accommodate the requirements of the firearm, such as Ruger 10/22 or 77/22.

In order that a single file relationship be maintained in the upper region of the housing as cartridges are removed from the housing, it is necessary to change the positional relationship of individual cartridges from a side-by-side relationship to a single file relationship as the cartridges move upward through the chamber 80. The manner in which this change of positional relationship is accomplished involves producing a force on the cartridges tending to urge at least some cartridges in a lateral direction (i.e. a direction substantially perpendicular to both the longitudinal axis of the cartridge and the longitudinal arcuate axis of the housing 60). This force is produced by a thickness which is progressively reduced in the transition zone 82 of the housing 60. As previously noted, the thickness of the housing 60 is defined by the distance between the second rails 56, 66. As seen in FIG. 7, the upper portion of the first wall first rail 54, which is in the transition zone 58, slopes inward (i.e. towards side wall 62). Thus, as shown in FIG. 1, as a cartridge moves from the position occupied by cartridge **21*b* to the position occupied by cartridge 47*a*, the narrowing of the chamber thickness resulting from the inward sloping of the first wall first rail 54 creates a force on the cartridge thus moved which has a component directed towards the second side wall 62 and results in lateral movement of the cartridge as it moves upward through the chamber 80. This lateral movement of the cartridge 47*a* is accommodated by separation of cartridges 21*a*, 47*b* so that cartridges 21*a*, 47*b* are no longer in contact with each other as they were when both cartridges 21*a*, 47*b*** were in the storage zone. In this manner, changing from a side-by-side positional relationship to a single file relationship of the cartridges is accomplished.

It has been found that careful attention must be given to the configuration of the inward sloping portion of the first side wall first rail 54 in order to avoid jamming. The manner in which the present invention avoids jamming is best understood after consideration of the forces which act on an individual cartridge as it moves through the chamber 80 and undergoes changing from a side-by-side positional relationship to a rotating, single file positional relationship.

The forces acting on a cartridge will be discussed in relation to cartridge **21*b* as it moves upward to occupy the position indicated in FIG. 1 by cartridge 47*a***, although similar force analysis will apply to other cartridges as they change from a side-by-side positional relationship to a single file positional relationship.

Cartridge **21*b* is acted upon by a number of forces as it is urged upwards through the chamber 80. Cartridge 21*c*, which is being indirectly urged upward by the follower device, exerts an upward force on cartridge 21*b*. Cartridge 21*c* exerts a force on cartridge 21*b* directed along the line from the center of cartridge 21*c* to the center of cartridge 21*b*. Similarly, cartridge 21*a* exerts a force on cartridge 21*b* along the line from the center of cartridge 21*a* towards the center of cartridge 21*b*. As discussed above, when cartridges 21*a*, 21*b*, 21*c* are in a side-by-side relationship, the centers of the rims 10, 12, 14 of these cartridges define the vertices of an equilateral triangle so that when the forces acting from the direction of cartridges 21*a*, 21*c* towards cartridge 21*b* are vector-summed, the resulting force has a component directed towards the point of contact of cartridge 21*b* with the first side wall first rail 54, the magnitude of which is related to the cosine of the vertex, defined by the center of cartridge 21*b*, of the equilateral triangle defined by the centers of cartridges 21*a*, 21*b*, 21*c*. This force component directed towards the first side wall first rail 54 is balanced by a force exerted by the first side wall first rail 54 towards the center of cartridge 21*b*. As cartridges are removed from the opened end 76 of the housing, cartridges 21*a*, 21*b*, 21*c* advance upward until cartridge 21*b* reaches a point where the thickness of the housing begins to narrow. This narrowing creates an increase in the force directed from first side wall first rail 54 towards the center of cartridge 21*b*. The amount of increase in force is related to how steeply first side wall first rail 54 slopes inward. As used herein, the slope of the first side wall first rail 54 is the incremental change in the lateral direction of the first side wall first rail 54 (i.e., the change in thickness of the first rail 54) divided by a given, incremental change in the vertical direction (i.e. in a direction along the longitudinal housing axis) of the first side wall first rail 54. In analytic terms, in a coordinate system where the X axis is directed in the lateral direction, as already defined, and the Y axis is directed in the vertical direction, the slope of the first side wall first rail 54** is dx/dy.

When the slope of the first side wall first rail 54 is too great, an excessive force component is created in the direction from the first side wall first rail towards the center of cartridge **21*b* as it moves through the chamber 80. This can produce jamming. Such jamming results from two causes. First, since the degree of friction between first side wall first rail 54 and cartridge 21*b* is related to the amount of force between first side wall first rail 54 and cartridge 21*b*, an increase in the force results in an increase in friction. When this friction increases to the point where it prevents cartridge 21*b* from freely sliding along first side wall first rail 54 so as to move upward through the chamber 80**, jamming results.

A second cause of jamming relates to the thickness of the housing 60. When the thickness of the housing 60 is sufficiently altered, the cartridges are no longer in the desired, nested relationship. As a result, jamming can occur due to cross over of cartridge rims or excessive lateral forces.

The configuration of the present invention also controls the lateral force exerted on the cartridge to maintain such force at a level sufficiently low that jamming is eliminated. The manner in which the magnitude of the lateral force is controlled involves the transition zone 82 in which the slope of the first side wall first rail 54 is configured so as to maintain the lateral force below a desired level.

In order to understand the configuration of the first side wall first rail 54, which will produce the desired control of lateral force, it is necessary to once again consider the forces acting on an individual cartridge as the cartridge enters the region of narrowed thickness and moves further towards the opened end 76 of the housing 60. As noted above, as cartridge **21*b* first enters the region of reduced thickness, it is exposed to a force from the first side wall first rail 54 which is directed towards the second side wall 62 and it also is subjected to the sum of the forces from cartridges 21***a*, 21*c* which tends to push cartridge 12 towards the first side wall first rail 54. This second force, as noted, is related to the cosine of the angle of the vertex at the center of the rim 12 of cartridge 21*b* of the triangle defined by the centers of the rims of cartridges 21*a*, 21*b*, 21*c*, i.e., the cosine of 60°. As cartridge 21*b* moves further up into the region of reduced thickness, the angle at said vertex at the center of the rim 12 of cartridge 21*b* becomes greater than 60° because the positional relationship of the cartridges is changing from a side-by-side relationship to a single file relationship, as already discussed. Thus, as cartridge 21*b* moves upward through the region of reduced thickness, the force which results from cartridges 21*a*, 21*c* decreases because the angle of the vertex at the center of cartridge 21*b* increases beyond 60° causing the cosine of that angle to decrease. Since the force tending to press cartridge 21*b* against first side wall first rail 54 is largest when cartridge 21*b* first enters the region of narrowed thickness, it is at this point that the force created from the first side wall first rail 54 must be most stringently controlled, i.e., it is at this point that the slope of the first side wall first rail 54 must be smallest. As cartridge 21*b* moves farther through the region of narrowed thickness and thus is less subject to the force tending to press it against the first side wall first rail 54, it is possible to increase the slope of the first side wall first rail 54, and thus increase the force acting from the first side wall first rail 54 against cartridge 21*b* without creating an excessive force, i.e., a force which is sufficiently high that jamming results.

The present invention then includes a first side wall first rail 54 which, in the transition zone 82, i.e., the region of reduced thickness, always has a slope configured to control the lateral force on a cartridge so as to prevent jamming. The slope in the upper portion of the transition zone 82 can be greater than the maximum allowable slope for the lower portion of the transition zone 82. Thus, the transition zone can be subdivided into a first portion 96 in which the first side wall first rail 54 has a first slope and a second portion 98 in which the first side wall first rail 54 has a second slope which can be greater than the first slope. The slope of the first side wall first rail 54 in the second portion 98 may be constant to produce a straight or linear surface in the second portion 98, or the slope of the first side wall first rail 54 in the second portion 98 may vary. In the embodiments depicted in FIGS. 1–11, the slope in the second portion 98 continuously varies in such a manner as to produce a first side wall first rail 54 having a parabolic shape in the second portion 98. However, it should be understood that configurations other than parabolic could be employed, such as ellipsoid.

From the above description with respect to the parabolic-shaped first side wall first rail 54 in the second portion 98, it is readily understood that cartridges, in moving from the storage zone 58 to and through the transition zone 82, experience increasing dx/dy rail increments. For example, greater X movement for a given Y increment occurs for a cartridge moving from the position occupied by cartridge 21*b* to the position occupied by cartridge 47*a* than is experienced by a cartridge moving from the position occupied by cartridge 47*a* to the position occupied by cartridge 47*c*.

The transition zone 82 also includes, in the preferred embodiment, a pair of restraining members 99, 101, as illustrated in FIGS. 4, 5, 7 and 11. As can be seen from the figures, the restraining member 99 is connected to or integral with the inner surface of the first side wall 52 and is located between first and second rails 54, 56. Similarly, restraining member 101 is connected to or integral with the inner surface of the second side wall 62 and is located between first and second rails 64, 66. Each of the two restraining members 99, 101 extends into the chamber 80 and together act to prevent unwanted insertion of a cartridge rim into the chamber 80. In particular, in loading or inserting a cartridge into the magazine of the present invention, it might be desirable to position the cartridge parallel to the magazine at its opened end and then insert the cartridge into the magazine with the rim of the cartridge being the leading end. In such a case, the cartridge rim could be inserted too far into the chamber by the user creating a disruption of the nested relationship of the other cartridges in the magazine and thereby cause jamming. To overcome this potential problem, the two restraining members 99, 101 are located to prevent the cartridge rim from extending too far into the chamber 80. That is, the distance or space between the two restraining members 99, 101 is insufficient to permit the passage of a cartridge rim, but such a space is of a size to permit the passage of the body portion and the nose end of the cartridge.

In the preferred embodiment, the first side wall second rail 56 also slopes inwardly in the transition zone 82, having substantially the same contour as that of first side wall first rail 54. When cartridge 21*b* has entered the transition zone 82, the amount of force directed from cartridges 21*a*, 21*c* towards cartridge 21*b* is related to the amount of force exerted upwards on the cartridges by the follower device. Thus, in order to maintain proper control on the force of the first side wall first rail 54 against the cartridge 21*b*, some consideration must be given to the magnitude of the force which is created by the biasing of the follower device. Certain types of biasing device, in particular, compression springs are subject to a large variation in the force produced by the spring as the spring changes from a fully compressed to a relaxed configuration. Thus, if this type of spring is used, it is necessary to design the slope in the first portion of the transition zone to accommodate the large force produced by a compression spring-biased follower when the housing is fully loaded and the spring fully stressed. Since, as noted above, one of the purposes of this invention is to allow storage of the maximum number of cartridges in the minimum length housing 60, it is desired that the first portion 96 of the transition zone 82 have as great a slope as can be tolerated since as the slope decreases, the overall length of the housing 60 which will accommodate a given number of cartridges must increase. Therefore, it is preferred to employ a biasing device for the follower device which is subject to little if any variation in the degree of force produced as the follower device moves upward through the chamber 80. In this way, the maximum force produced by the spring can be reduced, allowing the slope of the first portion 96 of the transition zone 82 to be increased and the length of the first portion 96 to be reduced, relative to magazines using other types of biasing devices.

Figure 9:
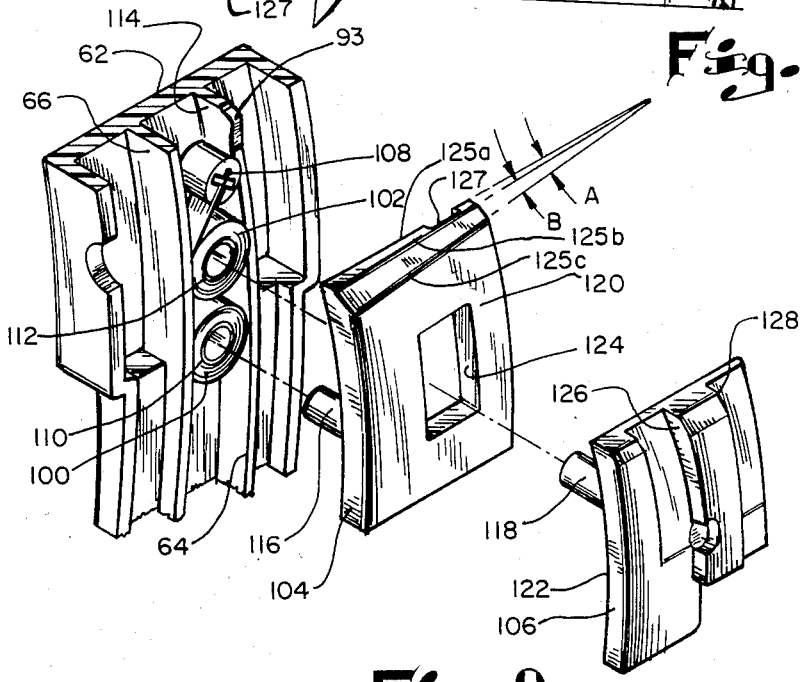
FIG. 9 is an exploded view of the split follower showing its relation to the second half of the magazine.

Such a preferred biasing device is a constant force spring. One such constant force spring configuration is depicted in FIG. 9. This biasing device is in the form of two spiral springs 100 and 102. Two springs are provided because the follower device is configured in the form of a dual or split follower for a purpose to be described below. For the present purpose, it suffices to state that the first spring 100 acts to bias a first follower 104 and a second spring 102 acts to bias a second follower 106 of the split follower. One end of each of the springs 100 and 102 is attached to an anchor 108. The remaining portions of the springs 100 and 102 are wound, in substantially relaxed condition, around first and second hubs 110, 112 respectively. The springs 100, 102, anchor 108 and hubs 110, 112 are disposed in a side wall groove 114.

A post 116 is attached to the first follower 104. A post 118 is attached to the second follower 106. The first follower post 116 acts as an axle for the first hub 110 and the second follower post 118 acts as an axle for the second hub 112 when the first follower 104 and the second follower 106 are assembled within the housing 60. When cartridges are inserted through the opened end 76 of housing 60, thus forcing downwards the first follower 104 and second follower 106, the first and second springs 100 and 102 are forced to unwind into a tensioned position, thus creating a force on the first follower 104 and the second follower 106 tending to urge the followers toward the open end 76 of the housing.

As best seen in FIG. 1, the spatial relationship of cartridges in the storage zone 58 of the housing 60 is such that the vertical distance between the lowermost cartridge 21*f* and the previous cartridge 21*e* is a constant value as long as cartridges 21*e*, 21*f* are within the storage zone. However, as cartridges are removed from the housing 60 and cartridges 21*e*, 21*f* enter the transition zone, cartridges 21*e*, 21*f* change from a side-by-side relationship to a single file relationship. As can be seen from FIG. 1, the vertical distance between successive cartridges in the transition is greater than the vertical distance between successive cartridges in the storage zone 58. In order to best maintain an upward bias on both of cartridges 21*e*, 21*f* in the transition zone 82, a split follower includiong the first follower 104 and the second follower 106 is used. The first follower 104 and the second follower 106 are movable with respect to each other. Specifically, as the distance between the lowermost cartridge 21*f* and the preceding cartridge 21*e* increases during passage upward through the transition zone 82, the first follower 104, since it is biased separately from the biasing of the second follower 106, is able to slide upwards with respect to second follower 106 so as to constantly maintain contact with the bottom of cartridge 21*e* at the same time that second follower 106 maintains constant contact with the bottom of the lowermost cartridge 21*f*.

As best seen in FIG. 9, the second follower 106 is slideably movable relative to the first follower 104. When the first follower 104 and the second follower 106 are assembled so as to be operatively connected within the housing 60, a first sliding surface 120 of the first follower 104 is adjacent to a first sliding surface 122 of the second follower 106. In order to produce independent biasing of each follower, a window 124 extends through the first follower 104 so that the second follower post 118 may extend therethrough to engage with the hub 112 of the second spring 102. The window 124 is of sufficient vertical extent to accommodate post 118 of the second follower 106 when second follower 106 is in either of its extreme positions with respect to the first follower 104.

The first follower 104 also includes edges 125*a*, 125*b*, 125*c* located at an upper portion thereof. The edges 125*a* and 125*b* each form an angle relative to the edge 125*c*. The edges 125*a* and 125*c* form an angle A while the edges 125*b* and 125*c* form an angle B. These two angles are illustrated diagrammatically in FIG. 9 in that both angles are shown having a greater magnitude than is actually utilized. The angle A is greater than the angle B and this configuration is provided to aid in proper positioning of the uppermost cartridge for delivery into the firearm, as well as to assist in positioning of adjacent cartridge noses in the desired contacting relationship. A slot 127 is formed in the first follower 104 adjacent to its upper portion. The slot 127 enables the follower 104 to move without engaging the projection 93 formed on the second wall first rail 64.

The second follower 106 is provided with first and second channels 126 and 128. These channels are included to accommodate the inward sloping rails. Specifically, as the second follower 106 moves upward through the transition zone 82, the first side wall first rail 54 occupies a progressively more inward (i.e. closer to second side wall 62) position and would contact and interfere with the upward movement of the second follower 106 if no accommodation were made for the first side wall first rail 54. By including a channel 128 in the second follower 106, a space is created within which the first side wall first rail 54 may lie as the second follower 106 moves upward through the transition zone 82. Similarly, the second channel 126 accommodates the inward-sloping first side wall second rail 56 as the second follower 106 moves upward through the transition zone 82.

Although the preferred arrangement includes the use of the two followers, it should be understood that the present invention could include, alternatively, a single follower device.

Figure 10:
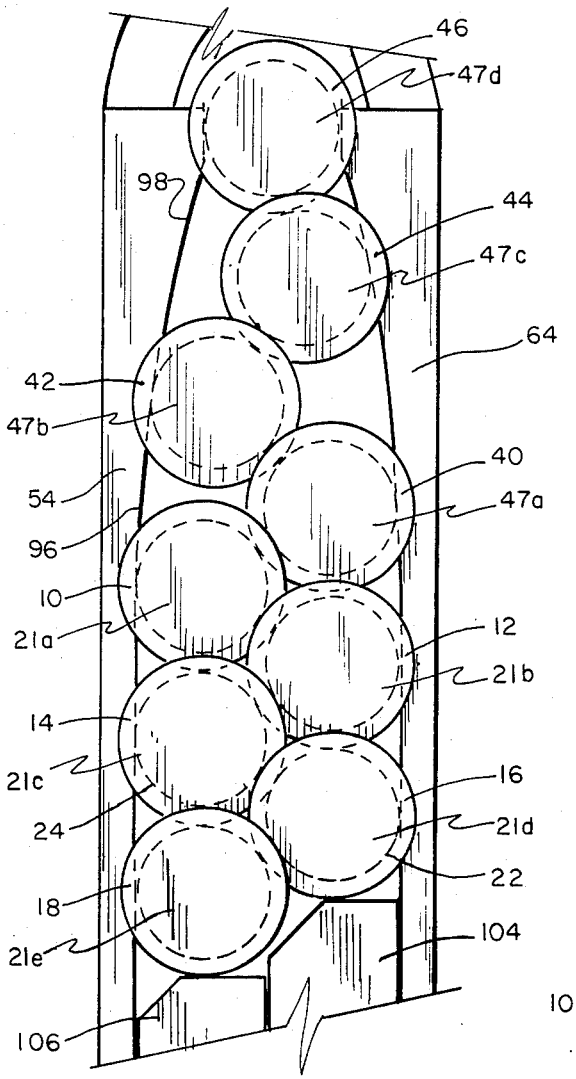
FIG. 10 is an enlarged, fragmentary, sectional view showing another embodiment in which inward sloping of the first rails of both first and second side walls is provided.
Figure 11:
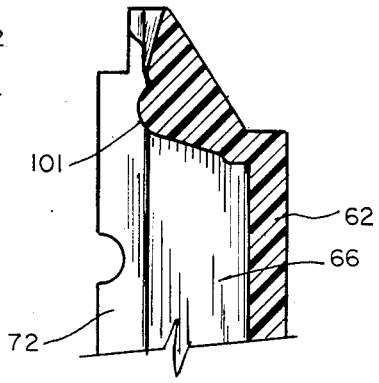
FIG. 11 is a fragmentary, cross-sectional view, taken along lines 11—11 of FIG. 5, showing the restraining member on the second half of the magazine.

The present invention can also be implemented with a magazine in which the reduction of thickness is accomplished by the inward sloping of both the first rail 54 and the first rail 64, as illustrated in FIG. 10. In the embodiment depicted in FIG. 10, the slopes of both of the first rails 54, 64 are such that the lateral force imparted to the cartridges as they move into and through the transition zone 82 is controlled to avoid jamming. In this embodiment both followers 104 and 106 will have channels to accommodate the sloping portions of the rails. However, as shown in FIG. 1, in the preferred embodiment, the first rail 64 and second rail 66 do not curve inward but are substantially flat throughout their entire extent. For this reason, it is not necessary to include a channel in the first follower 104 to accommodate the rails in the manner that channels are included in the second follower 106, but only slot 127 need be provided to accommodate projection 93.

In the embodiment shown in FIG. 1 in which the rails on the second side wall are substantially flat throughout their extent, a less complex follower device can be used, compared to the follower used in the embodiment shown in FIG. 10. If reduced thickness in the transition zone 82 is achieved by the inward sloping of rails both on the first side wall 52 and the second side wall 62, as shown in FIG. 10, it is necessary to provide slots to assure that the first follower 104 can travel throughout the full extent of the transition zone 82 to enable ejection of the lowermost cartridge when it reaches the uppermost position in the housing 60. Since, in the preferred embodiment, second side wall rails 64, 66 are in a substantially flat configuration, the first follower 104 can travel the entire extent of the transition zone 82 in a substantially straight manner without the necessity for channeling the first follower 104.

The manner of use of the magazine of the present invention will now be described. A number of cartridges are inserted into the housing 60 through the opened end of the housing 60. As each cartridge is inserted through the opened end 76, it is forced somewhat forward by the angled third section 90 of the first end wall 70 so that each inserted cartridge automatically assumes the proper nested relationship.

The housing 60 may be fully or partly loaded with cartridges, as is desired. The loaded housing 60 is inserted into a firearm, in a manner well known. Upon operation of the firearm, a mechanism is activated in the firearm to remove the topmost cartridge through the opened end of the housing 76 for firing by the firearm. Upon removal of the topmost cartridge, the plurality of cartridges in the housing 60 is moved through the chamber 80 towards the opened end 76 of the housing by virtue of the force created by the follower device which is biased towards the opened end of the housing 60. This upward movement causes the uppermost of the cartridges which lie in the storage zone 58 to enter the transition zone 82. As cartridges are removed through the opened end 76 of the housing 60 and cartridges move upward through the chamber 80 leaving the storage zone 58 to enter the transition zone 82, the inward sloping configuration of the first side wall first rail 54 creates a lateral force on the cartridges in the transition zone 82. The slope of the first side wall first rail 54 is sufficiently low to control the lateral force so that it does not reach a level where jamming resulting from such a force occurs. As the cartridges move through the chamber 80, the constant upward force created by the follower device maintains the body of each cartridge in contact with the rim of the preceding cartridge so as to maintain the cartridge rims in the nested relationship to prevent cross over and consequent jamming. As the lowermost cartridge 21*f* enters the transition zone 82, and assumes a single file, as opposed to a side-by-side, positional relationship, the first follower 104, being urged upwardly by spring 100 to continuously contact the bottom of cartridge 21*e*, slides upwardly with respect to the second follower 106.

Based on the foregoing detailed discussion of the present invention, a number of advantages of the invention are easily seen. The present invention can be used to store a number of cartridges in a two column configuration in a minimum volume, thus allowing for a side-by-side cartridge housing which minimizes the width and length requirements for a given number of cartridges. The present invention can be used to store rim-fire cartridges while eliminating the possibility of rim cross over and consequent jamming. The present invention can be used to control the amount of lateral force exerted on a cartridge as it is changed from a side-by-side to a rotating, single file relationship so as to eliminate jamming which can result from friction between a cartridge and a side wall or rail. The present invention automatically produces the desired nested relationship of the cartridge rims upon insertion of cartridges into the housing and maintains this nested relationship as the cartridges move through the chamber and are removed from the housing. The present invention can be used to maintain a relatively constant upward force on the cartridges as they move through the chamber, regardless of the change in configuration from a side-by-side relationship to a single file relationship.

Although the present invention has been described with reference to certain embodiments, it should be appreciated that further modifications can be effected within the spirit and scope of the invention. In particular, although the present invention has been described and depicted in relation to a magazine for housing .22 caliber rim-fire cartridges useful in connection with a Ruger 10/22 or 77/22 firearm, it is anticipated that the features of the present invention could be utilized in magazines for use with other cartridges and other firearms.

What is claimed is:

1. An apparatus for use in housing rim-fire cartridges in a side-by-side relationship comprising:

first and second side walls;

first and second end walls;

said first and second side walls and said first and second end walls forming a magazine having a chamber, a bottom end, and an opened end, said chamber including a storage zone and a transition zone, at least said storage zone being curved, said curved storage zone being defined using a radius;

a plurality of rim-fire cartridges, each of said rim-fire cartridges having a rim, a body portion, and a nose end, each of said rims of said plurality of cartridges being adjacent to said first end wall, and each of said rims of said plurality of cartridges being in a nested relationship wherein a portion of said rim of each of said cartridges lies between said first end wall and a portion of said rim of a preceding cartridge to prevent crossing of said cartridge rims during movement of said cartridges, at least some of said plurality of rim-fire cartridges being contained in said storage zone in a side-by-side relationship, wherein said rim-fire cartridges in said storage zone include a first rim-fire cartridge, a second rim-fire cartridge and a third rim-fire cartridge, said body portion of said third rim-fire cartridge being contacted by said rim of said first rim-fire cartridge and also by said rim of said second rim-fire cartridge, and wherein said some of said cartridges in said storage zone include a number of each of said first, second and third rim-fire cartridges; and means for producing a force in said transition zone to provide single file cartridges while avoiding jamming of the cartridges.

2. An apparatus, as claimed in claim 1, wherein:

said storage zone has a thickness for housing said cartridges in said side-by-side relationship, said thickness being about:

$$D + \frac{\sqrt{3}}{2}(D + \Delta r) \qquad \text{(i)}$$

where D is the diameter of one of said body portions and Δr is the radius of one of said rims minus the radius of the said one body portion.

3. An apparatus as claimed in claim 2, wherein:

said cartridge is a .22 caliber rim-fire cartridge and said thickness is between about 0.4 inches and about 0.5 inches.

4. An apparatus, as claimed in claim 2, wherein:

said first side wall includes at least a first rail and said second side wall includes at least a first rail and wherein the distance between said first side wall first rail and said second side wall first rail in said storage zone is between about 0.4 inches and about 0.5 inches.

5. An apparatus, as claimed in claim 1, wherein:

substantially all portions of said first end wall adjacent to said storage zone are configured using said radius while substantially all portions of said first end wall adjacent to said transition zone are not configured using said radius.

6. An apparatus, as claimed in claim 1, wherein:

said first end wall includes at least an arcuate first section and a straight second section and said first side wall includes a first rail and wherein said first rail has a slope in substantially the same part of the magazine that has said straight section of said first end wall.

7. An apparatus, as claimed in claim 1, wherein:

said second side wall includes a rail having a projection to assist in providing the desired nested relationship.

8. An apparatus, as claimed in claim 1, further including:

follower means having a surface with at least a first channel formed in said surface, and said first side wall includes at least a first rail, said first channel for receiving a portion of said first rail adjacent to said opened end of said magazine.

9. An apparatus, as claimed in claim 1, further including:

restraining means connected to at least one of said first and second side walls for preventing the unwanted insertion of a cartridge into said chamber, said restraining means being of a size to permit passage of said body portion and said nose end of said cartridge but of a size to prevent passage of said rim of said cartridge.

10. An apparatus for use in housing rim-fire cartridges in a side-by-side relationship comprising:

first and second side walls;

first and second end walls, said first end wall including a first section, a second section, and a third section, said first section being substantially arcuate-shaped, said second section being substantially straight, and said third section defining a predetermined angle relative to said second section;

said first and second side walls and said first and second end walls forming a magazine having a chamber, a bottom end, and an opened end, said chamber including a storage zone and a transition zone;

a plurality of rim-fire cartridges, each of said rim-fire cartridges having a rim, a body portion, and a nose end, at least some of said plurality of rim-fire cartridges being contained in said storage zone in a side-by-side relationship, each of said rims of said plurality of cartridges being adjacent to said first end wall, and each of said rims of said plurality of cartridges being in a nested relationship wherein a portion of said rim of each of said cartridges lies between said first end wall and a portion of said rim of a preceding cartridge to prevent crossing of said cartridge rims during movement of said cartridges; and means for producing a force in said transition zone to provide single file cartridges while avoiding jamming of the cartridges.

11. An apparatus, as claimed in claim 10, wherein:

said predetermined angle is at least 5°.

12. An apparatus, as claimed in claim 10, wherein:

said first section is defined by a radius and said radius is between 6 and 6.5 inches.

13. An apparatus for use in housing rim-fire cartridges in a side-by-side relationship comprising:

first and second side walls;

first and second end walls;

said first and second side walls and said first and second end walls forming a magazine having a chamber, a bottom end, and an opened end, said chamber including a storage zone and a transition zone, said first side wall including a rail having an upper section adjacent to said opened end and a lower section extending from said upper section, said upper section being offset from said lower section to minimize friction between said cartridges and said rail as said cartridges move towards said opened end;

a plurality of rim-fire cartridges, each of said rim-fire cartridges having a rim, a body portion, and a nose end, at least some of said plurality of rim-fire cartridges being contained in said storage zone in a side-by-side relationship, each of said rims of said plurality of cartridges being adjacent to said first end wall, and each of said rims of said plurality of cartridges being in a nested relationship wherein a portion of said rim of each of said cartridges lies between said first end wall and a portion of said rim of a preceding cartridge to prevent crossing of said cartridge rims during movement of said cartridges; and means for producing a force in said transition zone to provide single file cartridges while avoiding jamming of the cartridges.

14. An apparatus for use in housing rim-fire cartridges in a side-by-side relationship comprising:

first and second side walls;

first and second end walls;

said first and second side walls and said first and seocond end walls forming a magazine having a chamber, a bottom end, and an opened end, said chamber including a storage zone and a transition zone;

a plurality of rim-fire cartridges, each of said rim-fire cartridges having a rim, a body portion, and a nose end, at least some of said plurality of rim-fire cartridges being contained in said storage zone in a side-by-side relationship, each of said rims of said plurality of cartridges being adjacent to said first end wall, and each of said rims of said plurality of cartridges being in a nested relationship wherein a portion of said rim of each of said cartridges lies between said first end wall and a portion of said rim of a preceding cartridge to prevent crossing of said cartridge rims during movement of said cartridges;

means for producing a force in said transition zone to provide single file cartridges while avoiding jamming of the cartridges; and follower means for contacting lowermost rim-fire cartridges in said magazine chamber, said follower means including a first follower and a second follower, said second follower being movable relative to said first follower.

15. An apparatus, as claimed in claim 14, wherein:

said second follower slideably contacts said first follower in said storage zone.

16. An apparatus, as claimed in claim 14, wherein said follower means includes:

a post attached to said first follower for engagement with a first follower biasing means;

a post attached to said second follower for engagement with a second follower biasing means; and an aperture in said first follower configured to accommodate said post of said second follower.

17. A method for use in moving rim-fire cartridges in a magazine, comprising:

providing a magazine having an opened end and a bottom end for holding cartridges in a side-by-side relationship, said magazine including a chamber and said chamber having a transition zone and a storage zone, at least said storage zone being curved, said curved storage zone being defined using a radius;

providing a number of sets of three rim-fire cartridges, each of said sets of rim-fire cartridges including a first rim-fire cartridge, a second rim-fire cartridge, and a third rim-fire cartridge, each of said rim-fire cartridges having a rim and a body portion, each of said rims being of a greater diameter than each of said body portions;

positioning said cartridges in said storage zone in a side-by-side relationship wherein said positioning step includes contacting said body portion of said first rim-fire cartridge of a first set of said rim-fire cartridges by each of said rims of said second and third rim-fire catridges of said first set of rim-fire cartridges;

contacting, for each of other sets of said rim-fire cartridges, each of said body portions of said first rim-fire cartridge by each of said rims of said second and third rim-fire cartridges of said corresponding set;

causing movement of said cartridges in a direction from said bottom end of said opened end of said magazine;

changing said cartridges from said side-by-side relationship in said transition zone; and removing cartridges individually from said opened end of said magazine.

18. A method for use in moving rim-fire cartridges in a magazine, comprising:

providing a magazine having an opened end for holding cartridges in a side-by-side relationship;

providing a number of sets of three rim-fire cartridges, each of said sets of three rim-fire cartridges including a first rim-fire cartridge, a second rim-fire cartridge and a third rim-fire cartridge, each of said rim-fire cartridges having a rim and a body portion, each of said rims being of a greater diameter than each of said body portions;

positioning said cartrides in a side-by-side relationship in said magazine wherein said positioning step includes contacting said body portion of said first rim-fire cartridge of a first set of said rim-fire cartridges by each of said rims of said second and third rim-fire cartridges of said first set of rim-fire cartridges;

contacting, for each of other sets of said rim-fire cartridges, each of said body portions of said first rim-fire cartridge by each of said rims of said second and third rim-fire cartridges of said corresponding set;

moving at least one of said cartridges along an arcuate path towards said opened end;

moving said one cartridge along a straight path after leaving said arcuate path towards said opened end;

moving said one cartridge along an angled section after leaving said straight section towards said opened end; and removing said one cartridge from said opened end of said magazine.

19. A method for use in moving rim-fire cartridges in a magazine, comprising:

providing a magazine having an opened end and a chamber for holding cartridges;

providing a number of rim-fire cartridges, each of said rim-fire cartridges having a rim and a body portion, each of said rims being of a greater diameter than each of said body portions;

positioning at least some of said cartridges in said chamber in a side-by-side relationship;

providing a follower device having a first follower means and a second follower means contacting said first follower means;

moving said first follower means relative to said second follower means during movement of cartridges towards said opened end; and removing cartridges individually from said opened end of said magazine.

20. An apparatus for use in housing cartridges in a double column relationship comprising:

first and second side walls;

first and second end walls;

said first and second side walls and said first and second end walls forming a magazine having a chamber, a bottom end, and an opened end, said chamber including a storage zone and a transition zone, at least said storage zone being curved, said curved storage zone being defined using a radius;

a plurality of rim-fire cartridges, each of said rim-fire cartridges having a rim, a body portion, and a nose end, at least some of said plurality of rim-fire cartridges being contained in said storage zone in a side-by-side relationship, each of said rims of said plurality of cartridges being adjacent to said first end wall and each of said rims of said plurality of cartridges being in a nested relationship wherein a portion of said rim of each of said cartridges lies between said first end wall and a portion of said rim of a preceding cartridge to prevent crossing of said cartridge rims during movement of said cartridges; and at least a first rail extending in said storage zone and said transition zone, substantially all portions of said first rail in said transition zone having a slope, said slope being defined as the ratio of the change in the height to the change in distance of said first rail portions in said transition zone, and wherein said first rail portions in said transition zone include a number of first position and a number of second positions, each of said first positions being defined to be closer to said opened end than a second position and in which, for substantially each of any first and second positions, said slope at said first position being greater than, or equal to, said slope at said second position so that said substantially all first rail portions in said transition zone have an increasing or constant slope in a direction towards said opened end.

21. An apparatus for use in housing rim-fire cartridges in a side-by-side relationship comprising:

first and second side walls;

first and second end walls;

said first and second side walls and said first and second end walls forming a magazine having a chamber, a bottom end and an opened end, said chamber including a storage zone and a transition zone, at least said storage zone being curved, said curved storage zone being defined using a radius;

a plurality of rim-fire cartridges, each of said rim-fire cartridges having a rim, a body portion, and a nose end, at least some of said plurality of rim-fire cartridges being contained in said storage zone in a side-by-side relationship, each of said rims of said plurlaity of cartridges being adjacent to said first end wall and each of said rims of said plurality of cartridges being in a nested relationship wherein a portion of said rim of each of said cartridges lies between said first end wall and a portion of said rim of a preceding cartridge to prevent crossing of said cartridge rims during movement of said cartridges;

means for producing a force in said transition zone to provide single file cartridges while avoiding jamming of the cartridges, said means for producing a force including at least a first rail extending in said storage zone and said transition zone, at least portions of said first rail in said transition zone having a slope in which the height of said first rail increases towards said opened end and also having outer surface portions for contacting one or more cartridges, said outer surface portions curving wherein no one flat plane exists for containing said outer surface portions.

22. An apparatus for use in housing cartridges in a double column relationship comprising:

first and second side walls;

first and second end walls;

said first and second side walls and said first and second end walls forming a magazine having a chamber, a bottom end, and an opened end, said chamber including a storage zone and a transition zone;

follower means movable in said magazine chamber, said follower means including a first follower and a second follower, said second follower being movable relative to said first follower, at least portions of said first follower being in substantially continuous contact with portions of said second follower while said first and second followers are contained in said storage zone.

23. An apparatus for use in housing cartridges in a side-by-side relationship comprising:

first and second side walls;

first and second end walls;

said first and second side walls and said first and second end walls forming a magazine having a chamber, a bottom end, and an opened end, said chamber including a storage zone and a transition zone;

a plurality of cartridges, each of said cartridges having a rim, a body portion, and a nose end, at least some of said plurality of cartridges being contained in said storage zone in side-by-side relationship, each of said rims of said plurality of cartridges being adjacent to said first end wall, and each of said rims of said plurality of cartridges being in a nested relationship wherein a portion of said rim of each of said cartridges lies between said first end wall and a portion of said rim of a preceding cartridge to prevent crossing of said cartridge rims during movement of said cartridges;

means for producing a force in said transition zone to provide single file cartridges while avoiding jamming of the cartridges; and follower means for contacting lowermost cartridges in said magazine chamber, said follower means including a first follower and a second follower, said second follower being movable relative to said first follower.

* * * * *